US006560314B2

(12) United States Patent
Poulsen

(10) Patent No.: US 6,560,314 B2
(45) Date of Patent: May 6, 2003

(54) BEAM CONVERTER

(75) Inventor: Peter Poulsen, Livermore, CA (US)

(73) Assignee: The United States of America as represented by the Department of Energy, Washington, DC (US)

( * ) Notice: Subject to any disclaimer, the term of this patent is extended or adjusted under 35 U.S.C. 154(b) by 0 days.

(21) Appl. No.: 09/798,855

(22) Filed: Feb. 28, 2001

(65) Prior Publication Data

US 2002/0150213 A1 Oct. 17, 2002

(51) Int. Cl.[7] ..... H01J 35/08
(52) U.S. Cl. ..... 378/143; 378/119
(58) Field of Search ..... 370/143, 119

(56) References Cited

U.S. PATENT DOCUMENTS 3,609,432 A * 9/1971 Shimula ..... 313/59
4,012,640 A * 3/1977 McKnight et al. ..... 250/493
4,763,344 A * 8/1988 Piestrup ..... 378/119
6,085,965 A * 7/2000 Schwartz et al. ..... 228/190

* cited by examiner

*Primary Examiner*—Drew A. Dunn
*Assistant Examiner*—Irakli Kiknadze
(74) *Attorney, Agent, or Firm*—William C. Daubenspeck; Paul A. Gottlieb

(57) ABSTRACT

A converter and method for converting electron energy to irradiative energy comprising foam and/or foil. Foam and foil optionally comprise a high-Z material, such as, but not limited to, tantalum.

12 Claims, 9 Drawing Sheets

BEAM CONVERTER

GOVERNMENT RIGHTS

The United States Government has rights in this invention pursuant to Contract No. W-7405-ENG-48 between the United States Department of Energy and the University of California for the operation of the Lawrence Livermore National Laboratory.

BACKGROUND OF THE INVENTION

1. Field of the Invention (Technical Field)

The present invention relates to converters for producing X-rays (or other high energy radiation) from an electron beam.

2. Background Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

SUMMARY OF THE INVENTION (DISCLOSURE OF THE INVENTION)

The present invention comprises apparatus and methods for producing X-rays. In one embodiment, the present invention comprises a converter for converting electron energy to irradiative energy comprising foam wherein the foam comprises a high-Z material. This converter apparatus optionally comprises a holder for holding the foam wherein the holder optionally comprises at least one conical section.

In another embodiment, the present invention comprises foam and at least one foil wherein the foil optionally comprises a thickness on the order of, for example, a millimeter. Of course, thicker and/or thinner foils are within the scope of the present invention.

In yet another embodiment, the present invention comprises a converter for converting electron energy to irradiative energy wherein the converter comprises at least two foils wherein at least one of the at least two foils comprises a high-Z material. This converter optionally comprises a holder for holding the at least two foils wherein the holder optionally comprises at least one conical section. Of course, this converter optionally comprises foam as well.

In one embodiment, the present invention comprises a method of generating X-rays comprising the following steps: providing an electron beam; providing foam comprising a high-Z material; and administering the electron beam to the foam to thereby generate X-rays. In another embodiment, the invention comprises a method of generating X-rays comprising the following steps: providing an electron beam; providing at least two foils wherein at least one of the two foils comprises a high-Z material; and administering the electron beam to the at least two foils to thereby generate X-rays. In yet another embodiment, the present invention comprises a method of performing radiography comprising the following steps: providing a pulseable electron beam; providing foam comprising a high-Z material; administering at least one electron beam pulse to the foam to thereby generate X-rays; passing the generated X-rays through a sample; and registering the X-rays passing through the sample to thereby generate an image of the sample. Another embodiment comprises a method of performing radiography comprising the following steps: providing a pulseable electron beam; providing at least two foils wherein at least one foil comprises a high-Z material; administering at least one electron beam pulse to the foils to thereby generate X-rays; passing the generated X-rays through a sample; and registering the X-rays passing through the sample to thereby generate an image of the sample.

A primary object of the present invention is to facilitate mulitpulse radiography.

A primary advantage of the present invention is effective multipulse radiography.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
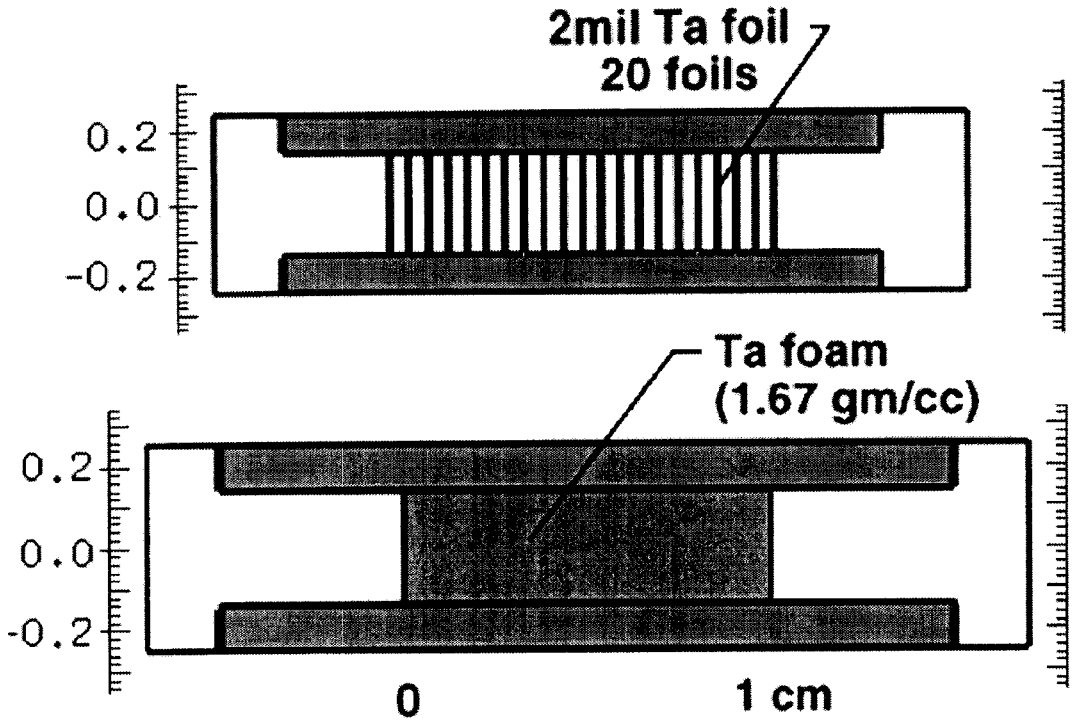
FIG. 1 is a diagram showing cross-sectional views of a foil array converter and a foam converter according to embodiments of the present invention.

DESCRIPTION OF THE PREFERRED EMBODIMENTS (BEST MODES FOR CARRYING OUT THE INVENTION)

The passage of a high-powered relativistic electron beam through an X-ray converter can vaporize and rapidly disperse the material. For radiographic applications desiring multiple pulses, such as the Dual-Axis Radiographic Hydrodynamic Test (DAHRT-II) facility, the converter material must either be replaced or confined for a period long enough to allow for multiple pulses. For multiple pulses into the dispersing material the electron beam will interact with an expanding plasma and a reduced line density. The present invention comprises converters or targets useful for single and multiple-pulses. Traditional converters usually contain a high-Z, full-density material with a thickness that ensures peak dose and a minimum spot size for the X-ray source. In at least one embodiment, the present invention comprises a converter material distributed, for example, over approximately ten times the thickness of a traditional target in the form of foils and/or foam and with full density confinement (e.g., radial) outside the electron-beam spot-size diameter. Examples presented herein show the radiographic effect of distributing converter material over a distance approximately ten times the usual, traditional target thickness. For multiple pulses over a microsecond time, hydrodynamic radial and axial flow plots are presented. According to the present invention, material reflux into the converter volume and the density remain at suitable levels as electron beam energy is deposited in the converter. The electron beam transport through an expanding low density plasma is shown to be relatively stable for a few centimeters and to give adequate electron beam spot size and divergence as it enters an inventive converter.

In a traditional Flash X-Ray (FXR) radiographic experiment, an electron beam is directed to a target or converter, for example, but not limited to, a tantalum slab or disk that comprises a thickness of approximately 1 mm. This traditional target is also referred to, in some instances, herein as a "solid" target, a single foil target and/or a slab or disk target. When the electron beam hits the target, the target material forms plasma that can flow away from the target, thus, leaving a "hole" in the target. A hole in the target, or a region of greatly reduced density, is undesirable if a train of electron beam pulses is administered, for example, to produce a time progressive, radiographic "multiple" exposure. The hole, or region of diminished density, can result in X-ray emission of inferior quality and consequently an inferior radiograph. Therefore, a need exists for methods and/or apparatus that reduce and/or eliminate pulse-to-pulse target degradation. The present invention addresses and satisfies this need through methods and apparatus comprising inventive targets or converters that comprise distributed material.

In one distributed converter embodiment, the target material is extended in space to lower the energy density in the target material while at the same time maintaining a line density substantially similar to that of a traditional target. In such an embodiment, the target material is confined by a holder, for example, in a direction substantially normal to the electron beam axis, that is capable of withstanding resultant beam-target interaction forces and reflecting target material away from the holder and back to the electron beam path; thereby, making that material available for interaction with a subsequent electron beam pulse. In such an embodiment, X-rays produced by the beam-target interaction are generally forward scattered, such that the virtual source spot size of the X-ray emission does not substantially deviate from that of a traditional target. According to one embodiment, target material is regenerated in situ to compensate for material that is lost due to flow. In this embodiment, the corner between a constant radius portion of the converter material holder and the expanding radius portion is partially extruded inward by the hydrodynamic pressure on the holder and then heated by the next beam pulse edge. The extruded and heated material adds to the material seen by the beam as converter material. In this case the holder should be of like material to the converter. A variety of non-limiting distributed target material embodiments of the present invention are described herein.

In one embodiment, the present invention comprises a distributed X-ray conversion target or converter. According to this embodiment, the expansion velocity of the target material is modifiable through changes to material properties and material and/or material confinement geometry. In one embodiment, the distributed target comprises a multi-foil target that exhibits less material removal in a Flash X-Ray (FXR) device while substantially maintaining X-ray spot size and dose when compared to a traditional target, e.g., a single foil target. As described herein, the distributed (foam, foil arrays, etc.) targets or converters of the present invention are suitable for multi-beam pulse operations. In one example, three pulses were administered to a distributed foam target as opposed to a distributed multiple-film target; note that targets combining traditional target materials with foam are also within the scope of the present invention. In this example, the foam was confined radially by a holder (tube configuration) and the three pulses were administered in approximately one microsecond. When compared to traditional targets, this foam target yielded substantially similar results.

As discussed herein, the term "foam" refers generally to a target material comprising, for example, but not limited to, a metal, a metal alloy and/or a ceramic. Metal foams are commercially available (known to one of ordinary skill in the art) and available in a variety of cell sizes. Such foams include, but are not limited to, foams comprising tantalum and/or tungsten. Cell structures include, but are not limited to, open-cell, closed-cell and "cells" created through, for example, particle sintering. According to an embodiment of the present invention, foams are open cell pure refractory metal foams with a fractional percentage of carbon remaining in the foam. In general, an open-cell structure is beneficial to keep peak pressure upon electron beam heating relatively small.

Foam also includes a medium in which the target material can be imbedded and carried so it can be distributed over the required volume. More broadly, any method of distributing the target material in space, subject to the constraints of length, X-ray production, and radial dimensions is within the scope of the present invention. In general, foam should contribute in an insignificant way to the e-beam attenuation and the X-ray production: it should be low density and made of low atomic weight material.

In examples described below, a tantalum foam comprising a density approximately one-tenth that of tantalum was used. Of course, other density foams are also suitable for use as converter material.

In another example, results show that a DAHRT reduced pulse power format allows for a confined target line density sufficient for a train of approximately four pulses. As described herein, a radially confined foam target embodiment can be used with a train of four pulses delivered in approximately two microseconds. In such an embodiment, a satisfactory four-pulse radiograph can be obtained, without having to change target material between pulses. Of course, pulse trains comprising more than four pulses are within the scope of the present invention.

Flash X-Ray Devices

A Flash X-Ray device (FXR) is an induction linear accelerator specifically designed for diagnosing hydrodynamic tests and radiographing the interior of an imploding high-explosive device. Its X-rays penetrate and are scattered or absorbed by the materials in the device, depending upon the density and absorption cross section of the various interior parts. The X-rays that are neither absorbed or scattered by the device form the image on photographic emulsions or on the recording surface in a gamma-ray camera.

An injector introduces an electron beam into the FXR accelerator. After passing through the accelerator, the beam enters a drift section that directs it toward a 1-millimeter-thick piece, e.g., film, of tantalum, called a target. As the high-energy electrons pass through the target, the electric field created by the stationary charged particles of the heavy tantalum nuclei (or other nuclei) causes the electrons to decelerate and radiate some of their energy in the form of X-ray radiation. The product of this slowing process is called Bremsstrahlung, which is a German word for "braking" radiation. The X-ray photons travel toward the exploding device, where most are absorbed. The photons that make it to the camera are the image data.

Other such instruments include the Linear Induction Accelerator X-ray Facility (LIAXF), which is a pulsed X-ray radiographic machine at Institute of Fluid Physics, Chengdu, China. The instrument produces X-ray by impacting an electron beam on target with beam parameters of 10 MeV, 2 kA with 90 ns pulse width (FWHM). The machine was upgraded to LIAXMU by increasing beam energy and current and reducing its spot size in 1996 in order to increase the capability of penetration. Experimental results of beams having parameters of 12 meV, 2.6 kA with 90 ns pulse width and about 4 mm spot size have been obtained for the LIAXF.

Another X-ray flash instrument is housed at the AIRIX flash X-Ray Radiographic facility, Moronvilliers, Champagne, France. In general, X-ray flash instruments deliver radiation that enables the capture of radiographic images of super-dynamic objects. The AIRIX instrument has a 3.5 kA/4.0 MeV/60 ns injector and 64 induction cells powered by 32 H.V. generators (250 kV per cell). At the exit of the flash X-ray photography accelerator AIRIX, an intense relativistic electron beam (4 kA, 16–20 MeV, pulse length of 80 ns) impinges on a high Z substance or material to generate X-rays. Material is classified as "high-Z," where Z represents the number of protons in the nucleus of the atoms, as well as the number of electrons in the neutral atom. "High" refers to placement near the upper end of the atomic materials chart, classified according to the number of protons. The quality of the radiography obtained is directly tied to the properties of the electron beam. Studies performed on a LELIA linac, 1–2 MeV, 1 kA for purposes of optical diagnostics (Cerenkov effect with a $SiO_2$ target) and beam size measurement the beam size observed a very strong perturbative effect. The size of the focal spot was observed to vary with time during the beam pulse. This observation was confirmed through additional studies with the PIVAIR induction linac (8 MeV, 4 kA, pulse length of 80 ns). An analysis of these experiments yielded an explanation for the emission of positive ions by the target and their subsequent tendency to move upstream. The first successful qualification experiment of AIRIX was reported on Dec. 2, 1999.

Converters and X-Rays

The present invention comprises a converter target for the production of X-rays. In one embodiment, a high-powered relativistic-electron beam interacts with a converter target material to produce X-rays. The converter material is typically vaporized and rapidly dispersed by the high-powered electron beam.

The Dual-Axis Radiographic Hydrotest (DARHT) facility, at the Los Alamos National Laboratory, Los Alamos, New Mexico, houses a X-ray flash instrument that uses an electron beam and a target to produce X-rays. The DARHT-II instrument has the ability to provide a rapid succession of four consecutive 20 MeV, 2 kA current pulses with various pulse lengths and time separations for focus onto millimeter spots on converter targets. See M. J. Burns, et al., "DARHT Accelerators Update and plans for Initial Operations", Proceedings of Accel. Conf., 1998, which is incorporated herein by reference. As the DARHT's electron beam passes through the material, it deposits energy and heats the material up to temperatures as high as several eV. "Blow-off" plasma results from the interaction of the beam and target, wherein plasma velocities range from approximately 0.5 cm/$\mu$s to approximately 3 cm/$\mu$s. A rapid succession of multiple pulses on, for example, a microsecond time scale, typically requires replacement or confinement of the target material. Strategies for replacement of target materials include use of a gas gun projectile, a shape charge jet, or a high-speed flywheel. According to an embodiment of the present invention, static converter material comprising a distributed form (i.e., a "distributed converter") is confined in a high-strength housing. For example, in one embodiment, static converter material, in a distributed form, is radially confined in a tube. Such embodiments are suitable for generation of X-rays from a rapid succession of beam pulses, for example, but not limited to, approximately three or four pulses.

Ideally, the first pulse into a distributed converter should have the same beam propagation dynamics as a single pulse into a conventional converter. Data are presented herein regarding radiographic aspects of spot size and dose for first pulses. For subsequent pulses, research has shown that an electron beam's focus may be affected by plasma charge neutralization effects created by a first pulse. See Yu-Jiuan Chen, P. M. Bergstrom, Jr., G. J. Caporaso, Darwin D.-M. Ho, J. F. McCarrick, P. A. Pincosy, and P. W. Rambo, "DARHT2 X-ray converter target system comparison", Proceedings of 1999 Accel. Conf., 1999. Data are presented herein regarding how the estimate of the beam envelope contributes to the subsequent pulse heating and radiographic source.

In general, repeated electron beam pulses interact with the dispersing material, consequently reducing the available line density. A forward-scattered energetic X-ray dose will reach a broad peak with increasing line density. In one embodiment of the present invention, a first pulse optionally comprises a larger line density so that subsequent pulses at lower line densities provide useful pulse-to-pulse doses. The dose dependence on the line density above some threshold density is a broad peak of almost constant dose. Provided the first pulse is into a given line density is well above the threshold, subsequent pulses at a reduced line density will produce substantially the same dose. Thus, the present invention also comprises an inventive method, which according to one embodiment, comprises administering a first pulse followed by at least one subsequent pulse, wherein the subsequent pulses are administered to a target comprising line density less than that of the first pulse. According to this embodiment, e.g., for at least two subsequent pulses, the at least two subsequent pulses experience substantially similar line densities. Such a result.is unlikely to be achieved for a pulse train (e.g., a first pulse followed by at least two subsequent pulses) administered to a traditional target.

Data are presented and evaluated herein for the hydrodynamic response of inventive and traditional targets comprising radiographic material (e.g., high-Z material (for example, but not limited to, Ta and/or W) at nominal density and/or other densities) to energy deposited from an electron beam. The hydrodynamic response results are used, in conjunction with a Monte Carlo particle transport code, to compare subsequent radiographic pulses to a first pulse.

Converters for Multiple Pulses

In one embodiment, the present invention comprises a multi-pulse converter, as shown in FIG. 1A and FIG. 1B, that comprises, for example, but not limited to, standard one millimeter thick high density tantalum foils distributed over the length of the converter material housing. For example, as shown in FIG. 1A, standard foil material is distributed over a length of approximately 1 cm as a plurality of spaced foils. Another embodiment is shown in FIG. 1B wherein the material comprises foam. For example, but not limited to, foamed tantalum with a density of approximately 1.67 $gm/cm^3$ (same line density of approximately 1.67 $gm/cm^2$) to modify the expansion. Hybrid converters comprising foam and foil are within the scope of the present invention.

In the aforementioned foam and/or foil embodiments, the converter material is optionally confined within a full density, high strength housing, for example, but not limited to, a tube housing. Where the housing comprises a tube, the diameter comprises a distance of approximately twice the electron beam spot size. In the tube configuration, some of the outward expanding material reflects off the tube wall and returns to a central conversion region.

The presence of foam and/or foils reduces the peak pressure attained within the converter material at the end of each pulse in proportion to the increased volume, since the energy per gram is constant as the material is distributed in the volume. For example, in a high power beam passage, the equivalent full density pressure at the end of a pulse is approximately one megabar. Whereas, a ten-fold increase in the volume reduces the peak pressure below the material yield stress or pressure of a confining tube.

During pulsing, some of the expanding hot material is reflected from the confining-tube wall, returned to the axis of the beam path and therefore available for the next beam-pulse passage. Along the beam axis, the material is free to flow. In one embodiment, an approximately 1 cm in length converter material region and an approximately 2 cm in length confining tube housing provides an inertial time scale of a few transit times before the flow reduces the line density.

Distributed Converter—Beam Interactions

Figure 2:
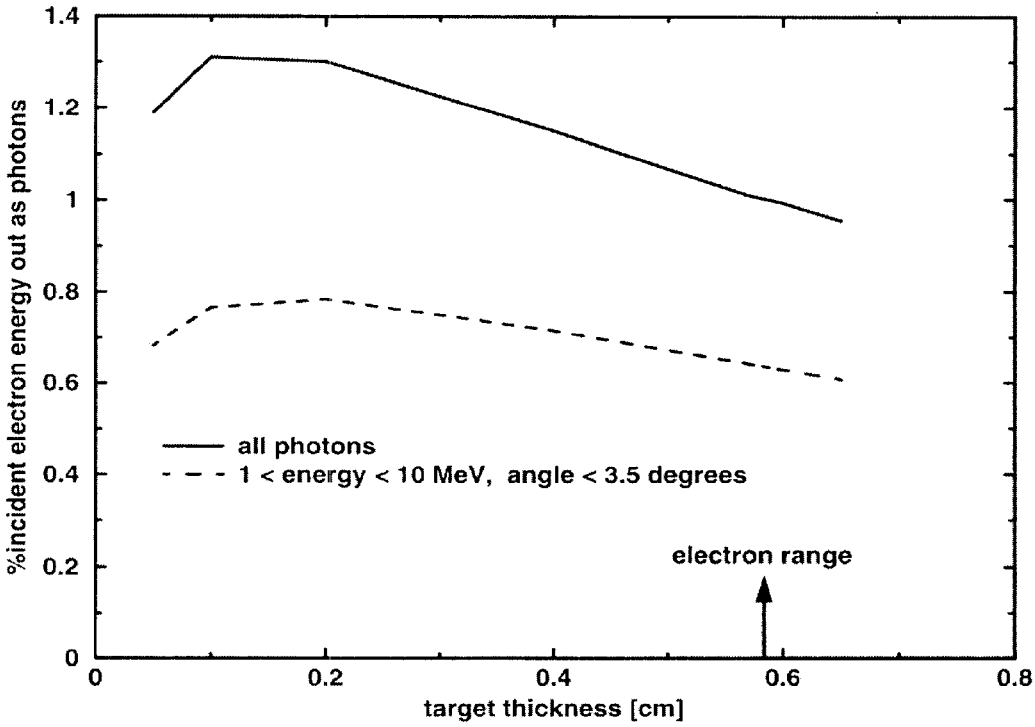
FIG. 2 is a plot of photon energy as a percentage of incident electron energy versus target thickness.

Typically a dose of forward-scattered energetic X-rays reaches a broad peak with line density (see, e.g., "PHERMEX: A Pulsed High-Energy Radiographic Machine Emitting X-rays", Ed. D. Venable, Los Alamos Scientific Laboratory Report LA-3241, May, 1967), thereby permitting a relatively large change in line density for a small dose change. For example, at 20 MeV, a four-fold decrease in line density from approximately 1 mm thick (1.67 $gm/cm^2$) to approximately 0.25 mm thick (0.415 $gm/cm^2$) can be made with only an approximately 20 percent reduction of the on-axis useful dose (photons within a few degrees). A plot of dose dependence (% incident electron energy out as photons) versus converter line density (cm) is shown in FIG. 2 for 20 MeV incident electron on tantalum.

As described herein, for a distributed converter, line density is spread out axially. Of course, the density can vary as of function of axial position in the housing. According to one embodiment, a combination of foam and foil is useful in creating varying density along the axis.

During pulsing, Coulomb scattering experienced by the electrons creates an angular dispersion of the electron trajectories.

In one embodiment, photon production for full energy collisions are forward scattered within a $1/\gamma$ angle (approximately 2 degrees for a $\gamma$=29). Because of the additional distance traveled for second X-ray production collisions, an increase in the radiographic spot size is expected.

Data presented herein show how an embodiment of the inventive distributed converter modifies the radiographic spot size and dose. Data were collected for an embodiment comprising 20 standard one-millimeter converter foils (20 foils, each foil comprising a thickness of approximately 2 mil (2/1000 inch or approximately 51 microns)) approximately equally spaced over a one centimeter length of a housing. This inventive foil array converter was installed in place of the traditional converter in the FXR radiographic instrument housed at LLNL. For a description of the FXR instrument at LLNL, see, e.g., B. Kulke, and R. Kihara, "Recent Performance Improvements on FXR," *IEEE Tran. Nucl. Sci.*, NS-30, 3030, 1983, which is incorporated herein by reference.

Data collected were for a 15 MeV, 2.3 kA and 70 ns electron-beam that typically produces an X-ray illumination spot size of 2.5 mm and total dose of 200 to 300 rad at one meter. The spot size was obtained by measuring the X-ray intensity distribution function produced by a thick target edge (for example, a roll bar of tungsten with a one meter curvature) that cuts off half the radiation cone. The dose was measured from the activation of an on-axis copper target.

Figure 3A:
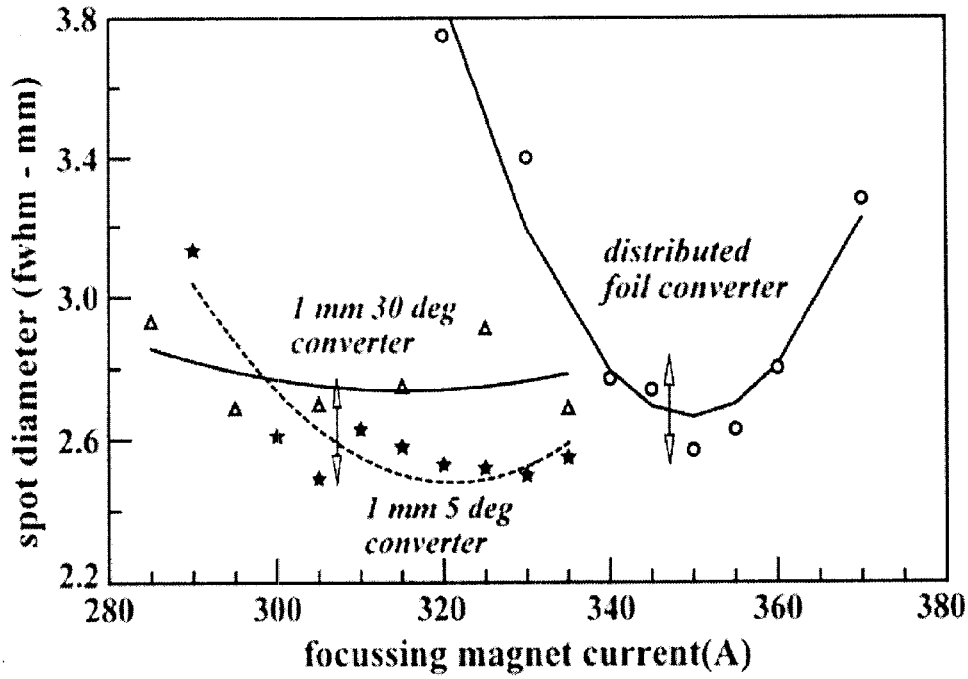
FIG. 3A is a plot of spot diameter versus focussing current for a traditional converter and a foil array converter.

The minimum X-ray illumination spot size was established by varying (tuning) the final focus magnet current for several shots and measuring the spot size and dose for each one. FIG. 3A shows a plot of spot size as spot diameter at FWHM in millimeters versus focussing magnet current in Amperes. As shown in FIG. 3A, while the optimum focussing magnet current differed, the minimum spot size did not substantially change in going from the traditional one-millimeter thick converter (open triangle symbols) to the foil array converter (open circle symbols). The front surface position as noted by the z scale is arbitrary and does not relate to the experimental position.

Figure 3B:
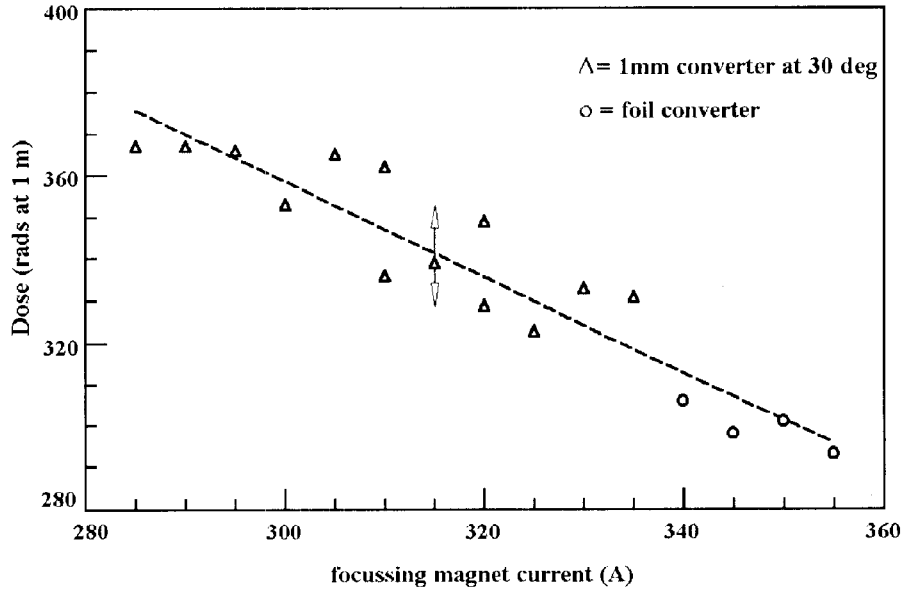
FIG. 3B is a plot of dose versus focussing current for a traditional converter and a foil array converter.

In general, radiation dose decreases as electron focussing-angle decreases; thus, the dose for a foil array converter is slightly smaller than that of a single foil converter. FIG. 3B shows a plot of radiation dose in rads at approximately one meter versus the focussing magnet current in Amperes. Because the distributed foil array converter dose data (open circle symbols) lie approximately on the same line as the traditional single foil converter dose data (open triangle symbols), the distributed foil array converter has essentially no influence on the dose.

In some of the pulses, or shots, a 5 mil (127 $\mu$m) KAPTON® (a polyimide film available through E.I. du Pont de Nemours & Co., Wilmington, Del.) foil was placed upstream of the magnet as a beamline protection method. This protection method prevents debris from the converter from reaching the FXR's distant cathode. The small amount of scatter on the electrons due to passage through the kapton foil did not affect the tuning results but did reduce the dose by approximately 30 percent at one meter.

Additional data for X-ray production were collected through numerical simulations using an electron gamma shower (EGS4) (Monte Carlo) code. See, e.g., D. W. O. Rogers, B. A. Faddegon, G. X. Ding, C.-M. Ma, J. Wei and T. R. Mackie, "BEAM: A Monte Carlo code to simulate radiotherapy treatment units," *Med. Phys.* 22 (1995) 503–524; and W. R. Nelson, Hideo Hirayama, and D. W. O. Rogers, "The EGS4 CODE SYSTEM," SLAC-Report-265, (1985), which are incorporated herein by reference.

Figure 4A:
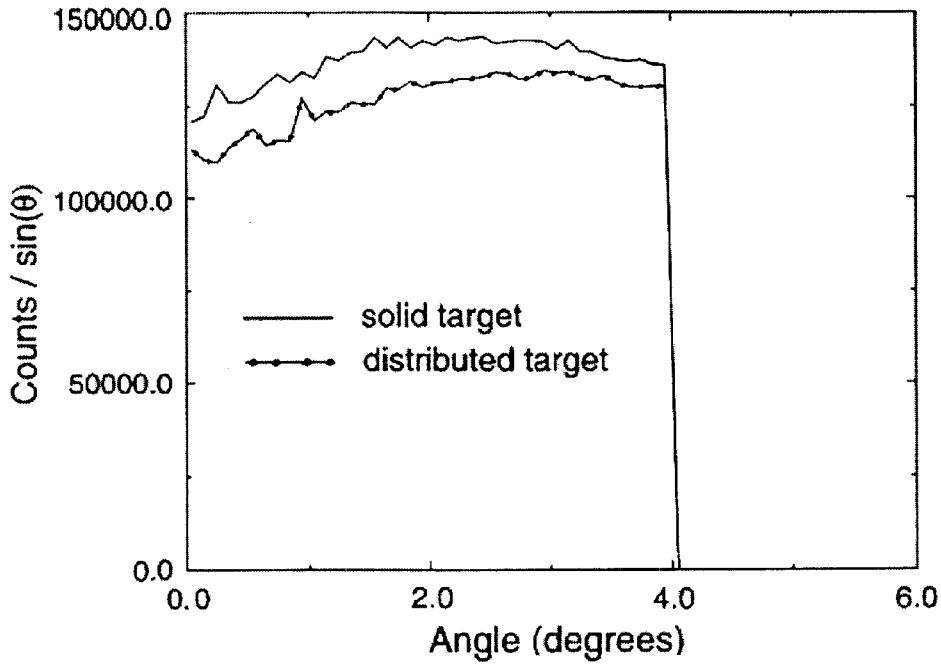
FIG. 4A is a plot of counts per sin Θ per angle for a traditional "solid" target and a "distributed" target according to an embodiment of the present invention.
Figure 4B:
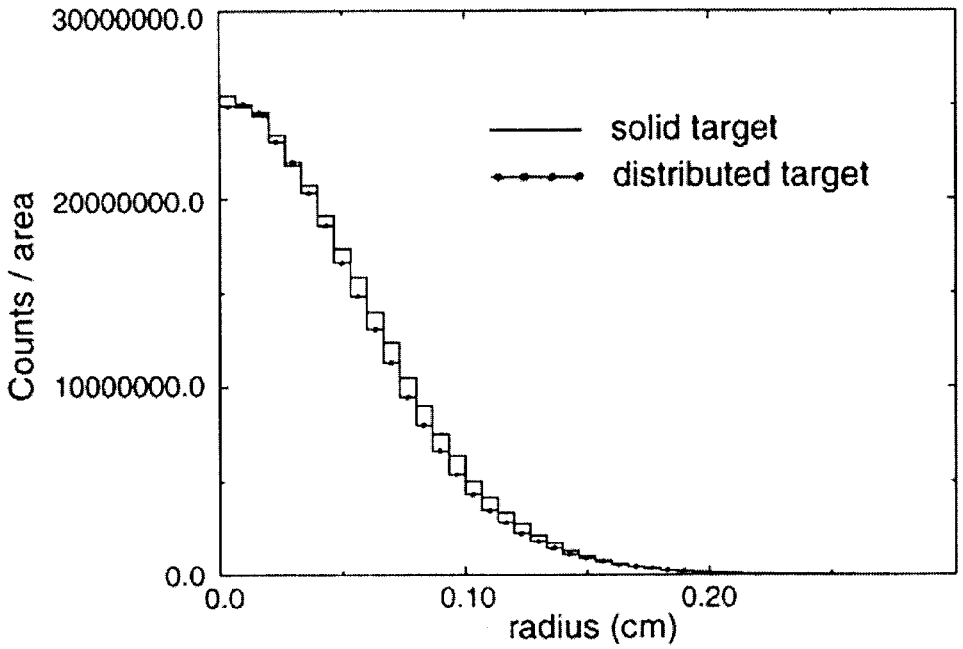
FIG. 4B is a plot of counts per unit area versus radius for a traditional "solid" target and a "distributed" target according to an embodiment of the present invention.

FIG. 4A shows a plot of counts per sin(Θ) versus forward scattered angle in degrees for a solid converter target and a distributed converter target. The counts per sin(Θ) for the distributed converter target are slightly less than for the solid target over a forward scattered angle range of approximately 0 degrees to approximately 4 degrees; the angular distribution was modified by approximately 10 percent. FIG. 4B shows a plot of counts per unit area versus the Bremsstahlung spot size radius in centimeters wherein plotted lines for the two results cross.

The hydrodynamic response to the electron beam energy deposition (about 2.7 KJoules per gm) was determined using a finite difference code (C-language Arbitrary Lagrangian-Eulerian or "CALE") for a 2.6 converter mm spot size Gaussian distribution with an average beam expansion angle of 5 degrees to account for Coulomb scattering. Details of the CALE code are disclosed in R. T. Barton, "Development of a multimaterial two-dimensional, arbitrary Lagrangian-Eulerian mesh computer program", Numerical Astrophysics, Alder, Fernbech and Rotenberg, eds., Jones and Barlett Pub., p. 211 (1985); and R. E. Tipton "A 2D Langrange MHD Code", Proc. Of the Fourth Int. Conf on Megagauss Magnetic Field Generation, Fowler, Caird, and Erickdson, eds., Plenum Press, New York, p. 299 (1987), which are incorporated herein by reference. Of course other 2-D and/or higher dimensional codes, whether finite element, finite difference, or other, known in the art of hydrodynamics, are expected to yield similar results.

Figure 5:
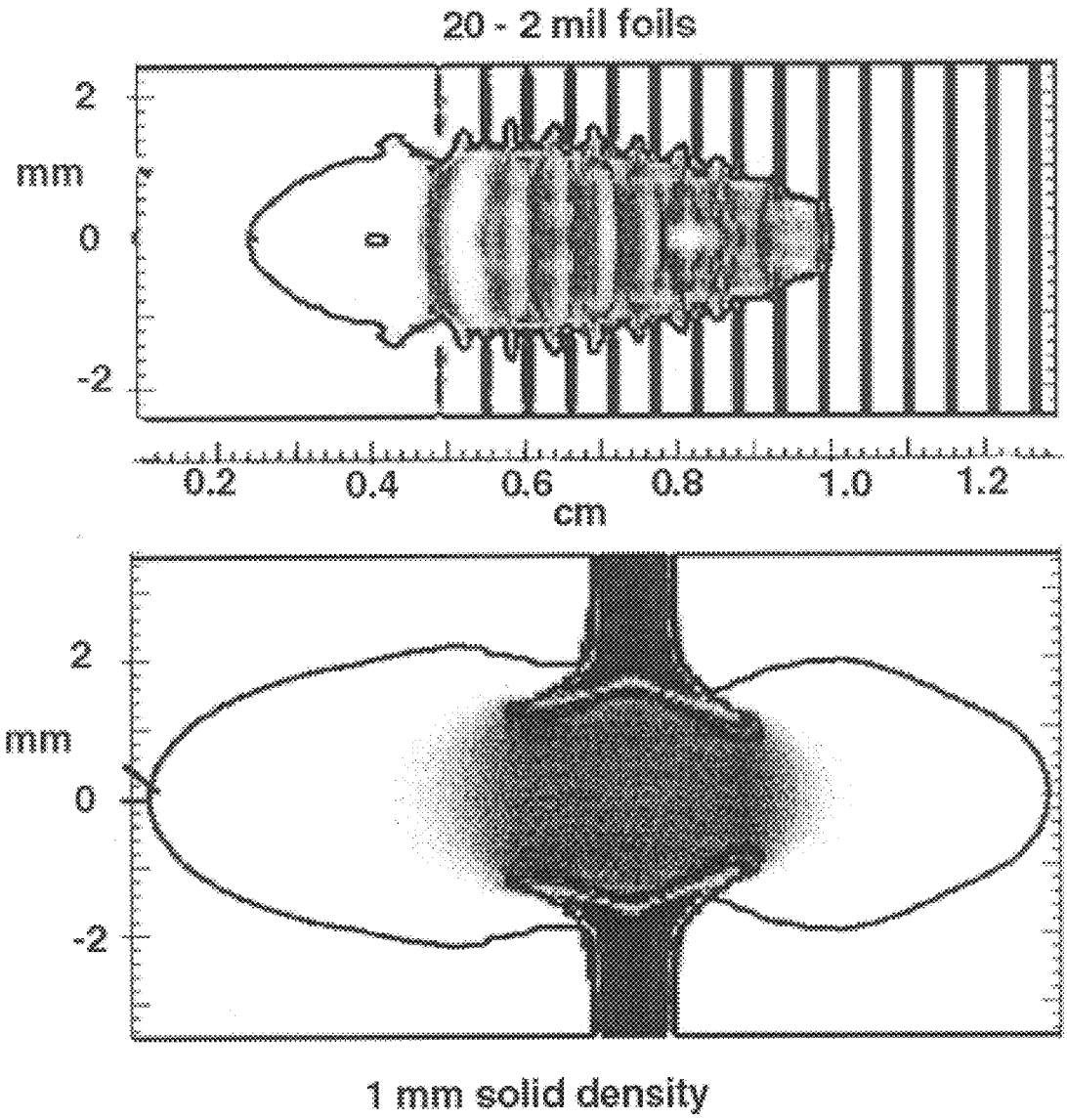
FIG. 5 is a diagram containing contour plots for a "distributed" target according to an embodiment of the present invention (upper) and a traditional "solid" target (lower)

FIG. 5 shows density distribution plots for the hydrodynamic response to an electron beam pulse for a traditional single foil converter (lower plot) and an inventive foil array converter of the present invention (upper plot). Note that the configuration of the foil array, or multiple film, converter shown in the upper portion of FIG. 5 corresponds to the foil array configuration shown in FIG. 1. Also note that the hydrodynamic response plot for the foil array converter corresponds to a time of approximately 800 ns (0.8 $\mu$s). The density distribution plots are based on data from the aforementioned calculations. The ordinate of each plot spans approximately 5 millimeters, from approximately −2.5 mm to approximately 2.5 mm.

An analysis of the data show that the hole-size of the traditional converter, at 0.8 $\mu$s, was only approximately 20 percent larger in diameter than that of the foil array converter; however, after the pulse, or shot, the hole-size was approximately twice as large that of the foil array converter. The density at the leading edge contour of the foil array converter, as shown in FIG. 5, was approximately 0.08 gram per cubic centimeter (te=0.9 eV) and the leading edge or front velocity was approximately 0.31 centimeters per microsecond. The density of the leading edge contour of the single foil converter, as shown in FIG. 5, was approximately 0.0005 grams per cubic centimeter (te=0.1 eV) and the leading edge or front velocity was approximately 0.8 centimeters per microsecond ($u_c$, the characteristic expansion velocity, was approximately 0.33 centimeters per microsecond and $u_t$, the thermal velocity of particles, was approximately 0.9 centimeters per microsecond). For the foil array converter, the calculation data and the actual data show holes only in the front half, approximately 14 of the foils. This result was due to divergence of the electron beam as the electrons scattered.

In general, distant free expansion of energetic material into a volume depends only on its energy and mass, for example, the characteristic expansion velocity into a vacuum equals the square root of twice the energy divided by the mass ($u_c=(2E/M)^{1/2}$). Thus, for a DAHRT electron beam wherein 600 Joules of energy are absorbed, a characteristic velocity of approximately 0.9 centimeters per microsecond results. In addition, the energy per unit mass is approximately constant for any target thickness.

A characteristic time is given by dividing the target, or converter, axial length by the characteristic velocity. For example, for an axial length of approximately 1 mm and a characteristic velocity of approximately 2 cm/$\mu$s, a characteristic time of approximately 50 ns results, likewise, an axial length of approximately 1 cm results in a characteristic time of approximately 500 ns. Overall, geometry and/or material modification can, in general, only modify the velocity for a few or so characteristic times.

As described herein, inventive converters are configurable to reduce the volume of target material removed in FXR operation. This result can be explained through use of the Hugoniot expansion for energy conservation: $E-E_o=p_o-p+u^2/2$, wherein, $E-E_o$ is energy added to the material by the electron beam, $p_o-p$ is material pressure, and u is the, material velocity. Again, as described herein, the effective volume at the end of a beam pulse is increased by, for example, configuring the target into a series of spaced thin foils as opposed to a single foil (thin or thick) target. Results for 20 foils (2 mil thickness, approximately 51 $\mu$m), spaced over approximately 1 cm, show that the foil expanded during heating and that the peak energy density was approximately one tenth that of a single foil target. The characteristic time for the single foil target was approximately 2 ns.

Beam Propaqation in Expanding Converter Plasma

In general, converter blow-off plasma expands during a multi-pulse train. The presence of plasma changes the beam propagation in three ways: (i) by neutralizing the beam's self-magnetic field and self-electric field; (ii) by increasing the thermal angle spread through Coloumb scattering; and (iii) by decreasing the beam energy through energy deposition.

Accordingly, each beam pulse in the pulse train has a different beam envelope because it propagates through a different amount of plasma plume. Thus, each beam pulse deposits energy into the converter differently. This phenomenon is demonstrable through hydrodynamic calculations. For example, for each incoming pulse, the converter plasma is modeled through a hydrodynamics calculation. The beam envelope (R) is then determined by solving the following envelope equation (Eq. (1)):

$$R^n + \left(\frac{eB_z}{2\gamma\beta mc^2}\right)^2 R - \frac{I}{\gamma^3\beta^3 I_o R}[1 - f_e - \gamma^2\beta^2(1 - f_m)] - \frac{\varepsilon^2}{R^3} = 0, \quad (1)$$

where $B_z$ is the final focus magnetic field; I, $\gamma\beta$, $\epsilon$ are the beam current, the normalized longitudinal momentum and the un-normalized beam emittance, respectively; $I_o=mc^3/e$ is the Alfven current; and $f_e$ and $f_m$ are the charge and current neutralization fractions caused by the plasma's neutralization effects. Note that Eq. (1) does not include a term corresponding to the longitudinal momentum change because the magnitude of that term is relatively insignificant compared to the magnitude of the other terms for a relativistic beam propagating through a plasma channel that is much shorter than its stopping range. The un-normalized emittance is simply rewritten as the product of the beam envelope (R) and the thermal angle ($\theta^2$) in the beam. Coulomb scattering is included in the model by adding the r.m.s. scattering angle given by the following equation (Eq. 2):

$$\langle\theta^2\rangle = \frac{4\pi Z(Z+1)}{\gamma^2} r_e^2 \ln\left(\frac{I}{I_o}\frac{a_o}{\lambda_c}\right)\int_o^{\varepsilon} n(z)\,dz \qquad (2)$$

in quadrature to the thermal angle in Eq. (1), where $r_e$, $a_o$ and $\lambda_c$ is the classical electron radius, the Bohr radius, and the Compton wavelength of the electron, respectively, and n(z) is the plasma number density.

The converter plasma provides charge neutralization forces and time varying magnetic forces on the electron beam pulse relative to the plasma's finite conductivity. Instead of modeling the time varying beam propagation in the plasma, a simplified approach is used wherein the plasma is separated into two regions according to its conductivity. In a first region, where the plasma comprises a conductivity of approximately less than 1 $mohm^{-1}$ $cm^{-1}$ and a corresponding plasma density of approximately $10^{12}$ $cm^{-3}$, the magnetic diffusion time is typically short compared to the electron beam pulse duration. For computational purposes, an assumption of no current neutralization forces on the electron beam is used within this first region. In a second region, where the plasma comprises a larger conductivity, it is assumed that current neutralization forces are finite ($f_e(z)$ and $f_m(z)$ equal to $n(z)/n_b(z)$ but not greater than 1, where $n_b$ is the beam density) and steady. Overall, beam propagation is modeled to a point where the electron beam is fully charged and current neutralized. Beyond this point, beam propagation is modeled with a Monte Carlo code that treats the plasma as a drift space with scattering and an energy loss. For an example of a Monte Carlo code see, e.g., W. R. Nelson, Hideo Hirayama, and D. W. O. Rogers, "The EGS4 CODE SYSTEM," SLAC-Report-265, (1985), which is incorporated herein by reference. Electron beam data at boundary between the two-region space and the drift space are used as initial conditions for hydrodynamic modeling and Monte Carlo calculations. Once the hydrodynamic modeling calculations of plasma expansion are complete, the procedure is repeated for the next electron beam pulse and its propagation in the plasma.

Beam Pulse Interaction Multiple Pulse Converter

Data from calculations and measurements for the foil array converter indicate only a small effect on a single beam-produced radiographic source. However, the hydrodynamic free expansion data is quite different, which is demonstrated by calculation of beam produced X-rays for several pulses into the expanding target material.

For ease of calculation, an inventive foam converter target positioned within a confining tube was modeled, see example of FIG. 1. The calculational procedure used a first pulse impinging on the foam converter's front surface with a Gaussian power distribution and expanding at an average Coulomb scattering angle summed in quadrature with the thermal diffusion angle. Hydrodynamics were calculated for the heating pulse according to the appropriate dE/dx for the electron energy.

At the desired time of the second pulse, the plasma density distribution and material conductivity were used to analytically determine the electron beam propagation up to the position wherein the conductivity excludes magnetic field. The envelope-focussing angle was added to the quadrature sum of the thermal and Coulomb scattering angles for the hydrodynamic calculation of the second pulse heating. The analytically determined electron beam spot size was also used. This process was followed up to the end of the four pulses over a maximum time of 2 $\mu$s. For each pulse the electron beam spot size and divergence were used to calculate the X-ray spot size and dose using the aforementioned Monte Carlo code. See also, e.g., W. R. Nelson, Hideo Hirayama, and D. W. O. Rogers, "The EGS4 CODE SYSTEM," SLAC-Report-265, (1985).

While results are presented for a train of four pulses, the number of radiographic pulses capable of being produced using the multi-pulse converter depends, for example, on the period during which pulses are applied and the energy deposition per pulse. For high intensity radiography, the absorbed electron beam energy creates a material pressure buildup of approximately a few megabar in the full density converter, depending on the current density and pulse duration. The limit velocity front expanding into a vacuum $u_c=(2E/M)^{1/2}$, where E is the total energy absorbed by the material mass, M. For a given beam energy and current density this characteristic velocity cannot be decreased because the material energy deposition from the beam electrons is almost constant. Changing the material geometry and density can modify the material acceleration time and the material pressure. The multi-pulse converter configuration reduces the peak pressure by increasing the volume in which the energy is deposited. Although the limit velocity is not reduced significantly, the reduced pressure allows radial confinement of converter material and changes the axial density evolution. Below, results for a few pulse format scenarios are presented where material dispersal allows for approximately three or four pulses.

Hydrodynamics

The aforementioned CALE code approximates the energy deposition from collisions using the radiation mean free path. Because the radiation path length includes the photon energy that leaves the converter the path length is corrected to account for this underestimate.

The trajectories are assumed to follow straight lines but the input distribution is specified with pace, angle and time. The material state is governed by the equation of state (modified Cowan model for the ions and Thomas-Fermi for the electrons) where the melt temperature and the Gruneisen gamma are input as an equation of state (EOS) model.

EXAMPLE 1

Three Pulses

The EOS model was used to determine performance of a foam comprising tantalum subjected to three beam pulses. The overall set-up was equivalent to that shown in FIG. 1. The approximately one centimeter length of tantalum foam, comprising a density of approximately 1.67 $gm/cm^3$, was confined in a tube comprising a diameter of approximately 2.8 mm. The train of three beam pulses comprised a line density of approximately 1.67 $gm/cm^2$ and were equally spaced over approximately one microsecond. A pulse current of approximately 6 kA, an energy of approximately 20 MeV, and an approximately 60 nanosecond pulse duration with an approximately one millimeter spot size (FWHM) were used. The resulting intense power deposition in the tantalum foam was calculated.

The three-pulse format, that comprised equally spaced pulses during an approximately one microsecond period, used an approximately 6 kA beam pulse current at an energy of approximately 20 MeV with an approximately 60 nanosecond pulse time. The beam was focussed to an approximately 1.4 mm spot size and directed into the tantalum foam converter.

Figure 6A:
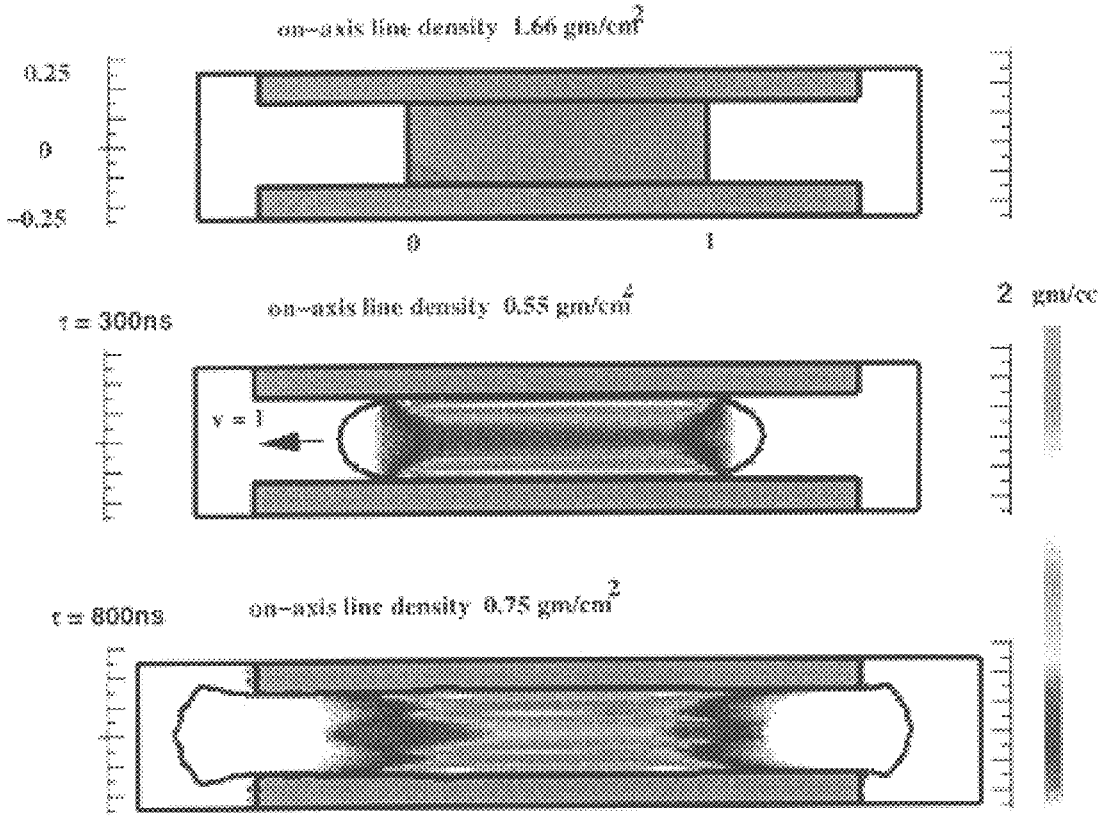
FIG. 6A is a diagram containing contour plots for a distributed target according to an embodiment of the present invention just prior to administration of three separate electron beam pulses.

Hydrodynamic flow is shown in FIG. 6A for times of approximately 0 s, 300 ns, and 800 ns. The converter was subjected to beam pulses at approximately 0 s, 450 ns, and 850 ns; thus, the results of FIG. 6A correspond to conditions just prior to administration of a beam pulse. As shown in FIG. 6A, time of 0 s, the tantalum foam converter occupied a length of approximately 1 cm in the converter tube. The on-axis line density was approximately 1.66 gm/cm$^2$ at 0 s, 0.55 gm/cm$^2$ at 300 ns and approximately 0.75 gm/cm$^2$ at 800 ns. A line density grayscale is shown to the right of the 300 ns and 800 ns results.

The 800 ns results show refluxing density waves. The low density expanding plasma front velocity was approximately 1.5 and 2.5 cm/$\mu$s for the second (450 ns) and third (850 ns) pulses, respectively. As shown in FIG. 6A, the converter material disappeared rapidly after one microsecond and left relatively insufficient line density. The two pulse format cases reveals potential limits of application for such a distributed converter. Higher energy electron beams and/or smaller spot sizes, result in a shorter time scale of application. The consequence of higher energy is to require that the converter comprise a relatively rapidly moving material for replacement between each pulse.

Figure 6B:
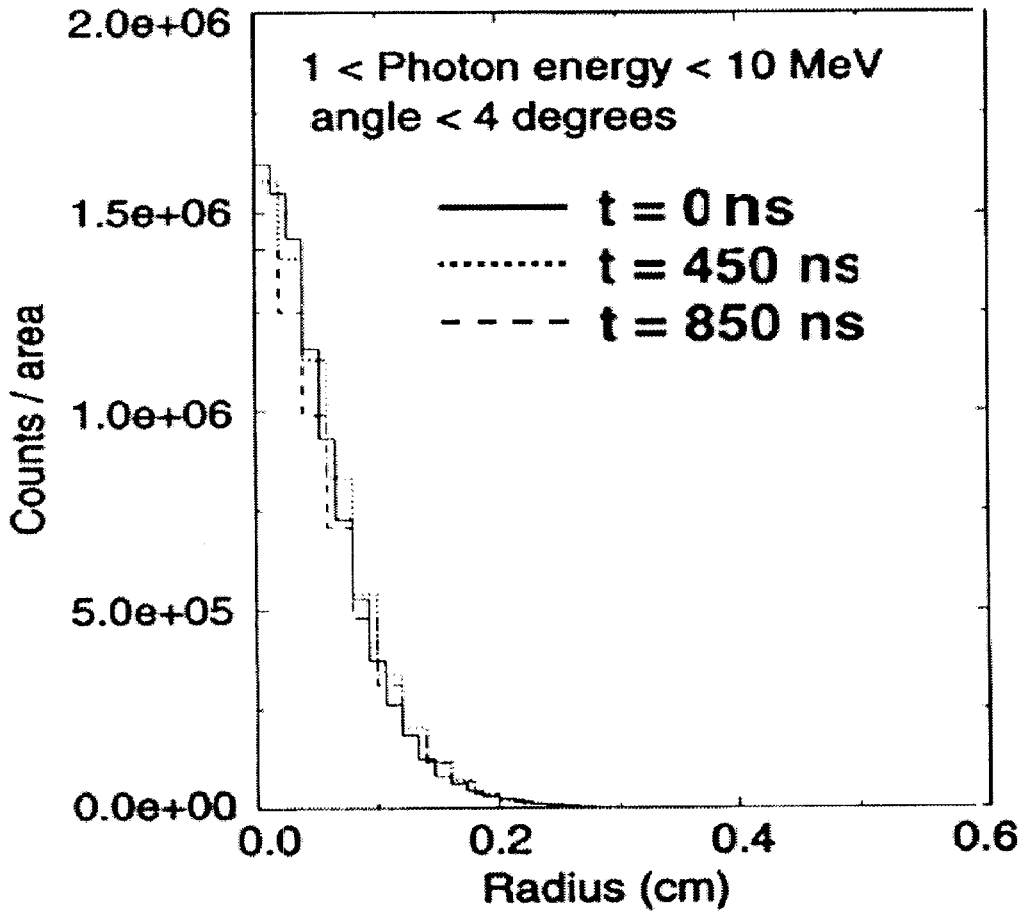
FIG. 6B is a plot of resulting counts per unit area versus radius for three electron beam pulses.

Spot sizes were determined as well, represented graphically in FIG. 6B. FIG. 6B shows a plot of counts per unit area versus spot size radius in centimeters for times of approximately 0 s (first pulse), 450 ns (second pulse), and 850 ns (third pulse). The results shown in FIG. 6B indication that the spot size increased slightly and that the useful dose (defined by 1 to 10 MeV photon and angle less than 4 degrees) decreased slightly while the total dose dropped by approximately 40 percent.

EXAMPLE 2

Four Pulses

A four-pulse train, set at a lower power, was examined for four pulses equally spaced over an approximately 2 microsecond period with a pulse current of approximately 2.3 kA, an energy of approximately 20 MeV and with various pulse durations. Again the converter comprised approximately one centimeter of tantalum foam comprising a density of approximately 1.67 gm/cm$^3$ within a 2.2 mm tube diameter of full density tantalum.

Figure 7:
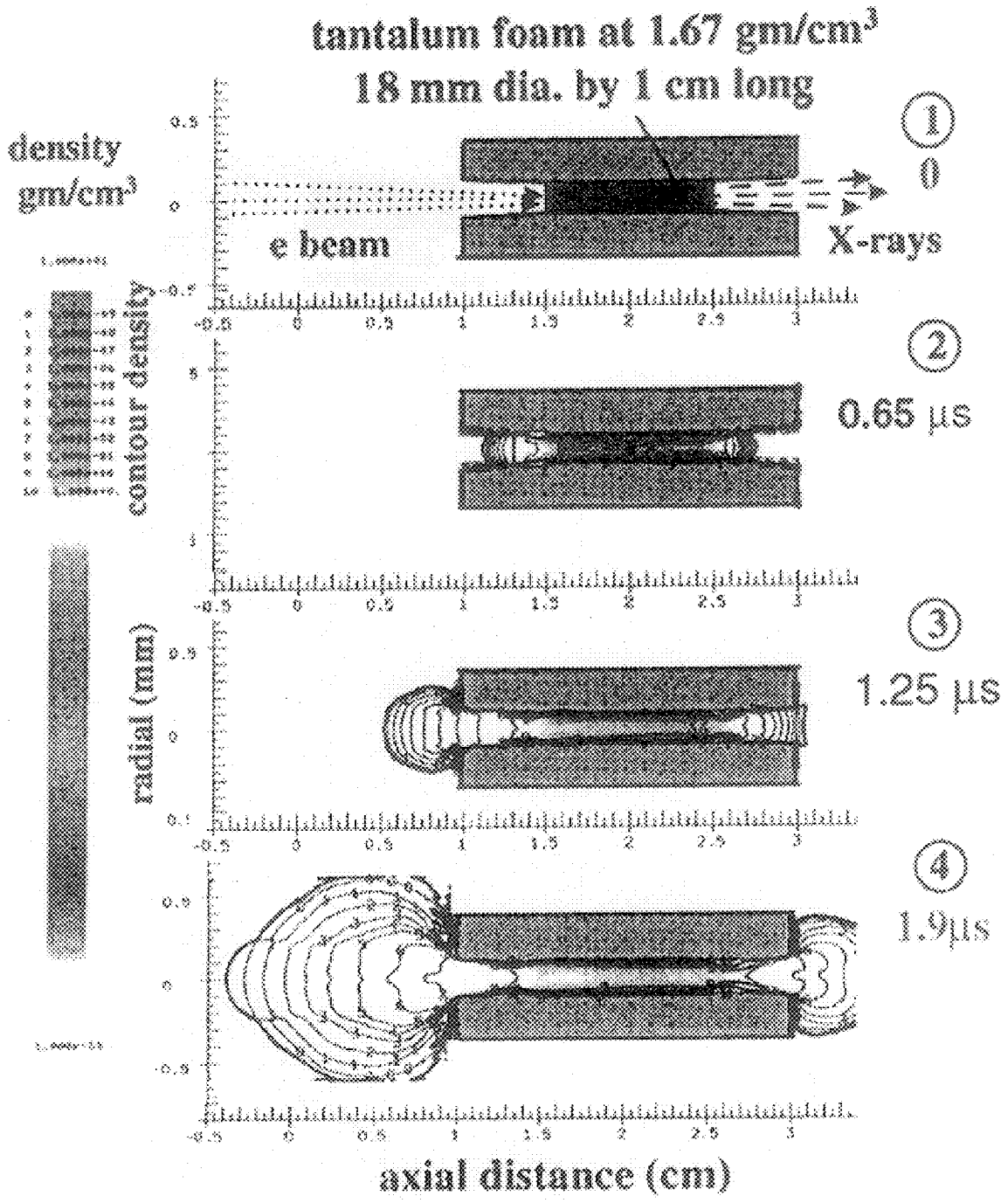
FIG. 7 is a diagram containing contour plots for a distributed target according to an embodiment of the present invention just prior to administration of four separate electron beam pulses.

Results are shown in FIG. 7 as plasma front and density contours just prior to administration of each pulse. These results show the temporal and spatial evolution of density where the boundary of the expanding front is the free expansion flow limit at the calculated density minimum (1e$^{-10}$ gm/cm$^3$). Each snapshot is at the time just before the electron beam arrives at the converter. Note that the entrance tube has a slight angle beginning from the exterior down to the approximately 1.8 mm constant diameter section holding the foam.

The four pulses were administered at approximately 0 s, 0.65 $\mu$s, 1.25 $\mu$s, and 1.9 $\mu$s. The corresponding density plots are shown in FIG. 7 from top to bottom for times just prior to pulses one through four, respectively. At the top of FIG. 7, an e-beam is shown entering a conical section of the converter or target holder and X-rays are shown exiting the converter. An approximately 1 cm long, 18 mm diameter foam target comprising tantalum is approximately centered in the target holder for converting e-beam energy to X-rays. Characteristics of the inventive foam target just prior to the second pulse are shown in the next plot. Contours are shown having densities according to the corresponding scale shown to the left of the plot. Below this plot, similar plots are shown for the third and fourth pulses.

The first pulse had an approximately 1.3 mm Gaussian spot diameter at the vacuum to tantalum interface at an axial position of approximately 1.5 cm. The divergence was approximately 2.5 degrees. The second and subsequent beam pulse optics and spot size were obtained as described in the section on beam propagation (above). Each pulse increased the energy of the material intervening the beam so that the expansion rate increased. The front velocity was approximately 1.2, 1.5, and 1.8 cm/$\mu$s before the second, third and fourth pulses, respectively.

Figure 8A:
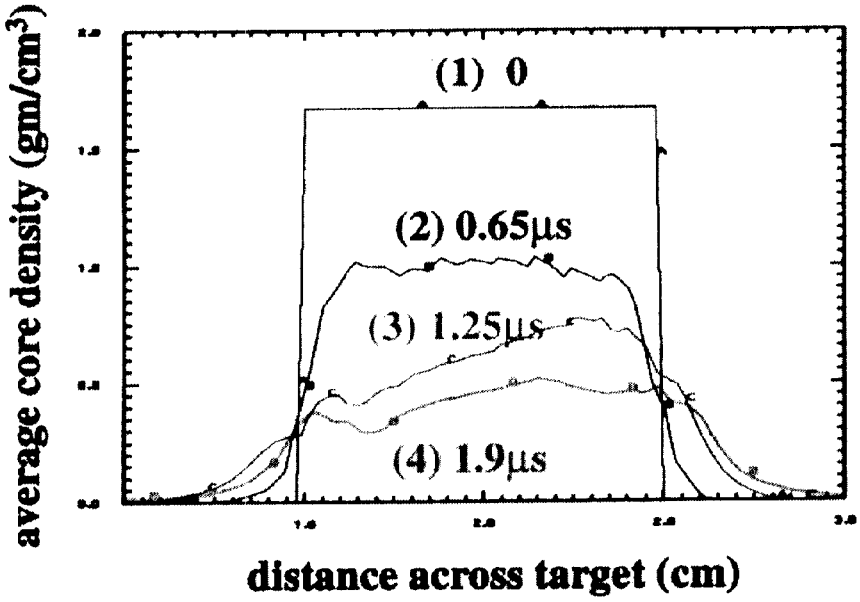
FIG. 8A is a plot of average core density versus distance across the target for four electron beam pulses.
Figure 8B:
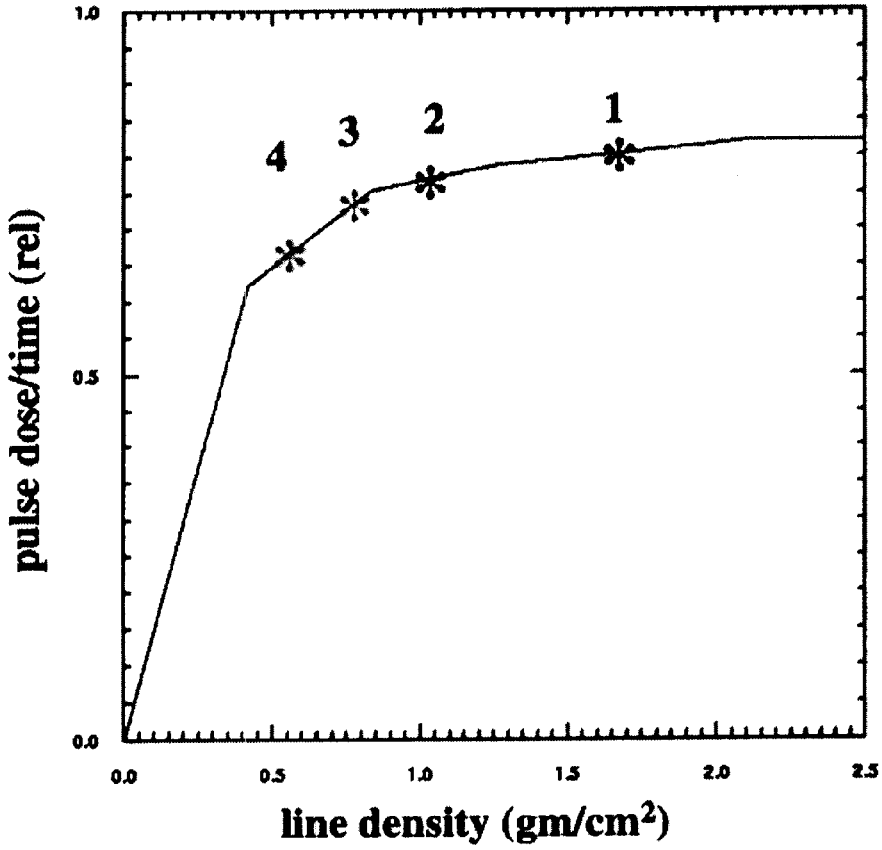
FIG. 8B is a plot of pulse dose per unit time versus line density for four electron beam pulses.

FIGS. 8A and 8B show further results of the four pulse train example. FIG. 8A shows a plot of average core density in grams per cubic centimeter versus distance across the converter target for times of approximately 0 s, 0.65 $\mu$s, 1.25 $\mu$s, and 1.9 $\mu$s. The density contours and plot of FIG. 8A show a relatively constant, albeit with reduced magnitude, density in the axial direction. Although the lower density plasma is flowing out the ends much of the original material either expanded out radially to the tube walls or refluxed radially from the wall.

Integration of the density along the axis yielded the line density experienced by the beam and the equivalent relative useful dose per unit time. These results are shown in FIG. 8B as a plot of pulse per unit time versus line density in grams per square centimeter for pulses one through four. Note that decreases in pulse dose between pulses one, two and three were relatively slight; the fourth pulse exhibited the largest decrease, however, this decrease was also slight.

For a larger margin of error for the fourth the length of the foam or the density of the foam could be increased at the expense of increased impulse pressure on the tube wall. The tube diameter is 1.8 mm compared to the beam diameter of 1.3 mm so that considerable beam energy is deposited in the wall. The wall material at the vacuum to tantalum foam interface gets deformed and heated enough to provide some material to the foam volume. If the tube wall diameter is larger the material reflux takes longer which could be beneficial depending on the spacing between pulses.

EXAMPLE 3

Four Pulses

In this example, a converter comprising tantalum foam contained in a tube holder was subjected to a train of four pulses. This converter example comprised tantalum at a density of approximately 16.7 grams per cubic centimeter that was placed inside a larger tube. The converter comprised a diameter of approximately 2.8 mm and a tantalum foam material density of approximately 1.12 grams per cubic centimeter. Each approximately 60 ns beam pulse comprised a diameter of approximately 1.56 mm FWHM at a current of approximately 2.5 kA and an energy of approximately 20 MeV. Pulses were applied to the converter at times of approximately 0.65 $\mu$s, 1.3 $\mu$s, and 1.9 $\mu$s.

EXAMPLE 4

Four Pulses

Performance of a foam converter was compared to that of a "solid" converter. Note that the term "solid" refers herein generally to a traditional converter, a single "thick foil" converter or a "standard" converter, for example, a one mm thick material at its nominal density; the scope of the present invention comprises use of such "solid" converters in conjunction with foil and/or foam converter material. Both converters comprised a diameter of approximately 2.2 mm.

In this example, the DAHRT pulse format comprised a current of approximately 1.8 kA, an energy of approximately 20 MeV and a beam diameter of approximately. 1.3 mm (Gaussian FWHM).

Pulses were administered to the converters as follows: a first pulse at was administered comprising a duration of approximately 16 ns; a second pulse was administered at a time of approximately 0.65 $\mu$s and at a duration of approximately 16 ns; a third pulse was administered at a time of approximately 1.3 $\mu$s and at a duration of approximately 22 ns; and a fourth pulse was administered at a time of approximately 1.9 $\mu$s and at a duration of approximately 80 ns.

In this example, radial flow of some material refluxed to enhance the line density for the second pulse and the third pulse. Overall, the foam target exhibited a more even target density distribution over the length of the target when compared to the solid target. In particular, the density distribution over the length of the foam target remained relatively constant after administration of the first, second and third pulses. In addition, for the last pulse, the target line density of the foam target was significantly better than that of the solid target.

Results plotted as log of the density versus axial converter distance in centimeters for four pulses in both the foam converter and the traditional converter showed that electron trajectories travel through a lower density path for the inventive foam target plasma flow. In general, the electron beam spot size and stability of beam optics depend on the propagation distance and plasma density. Increased distance and increased density produces beam instability and larger spot size. Good radiographs require consistent spot size.

The examples presented herein demonstrate the effectiveness of several embodiments of the present invention. These examples include examples with three high dose pulses (total dose of 5 krad) over one microsecond and four pulses over 2 microseconds with a total dose of 2 krad. For several embodiments, a requirement of constant dose per unit time translates to a lower line density limit of approximately 0.4 $gm/cm^2$. For several embodiments, the format time scale is limited by the energy deposited or the material speed of sound and geometry length scale. Examples presented herein show that for several embodiments enough material was confined to keep above this limit and that distributing the material over a longer distance permits more control of the radial hydrodynamic confinement.

Examples using FXR and a series of foils to make up the line density show dose and spot size agreement with calculations indicating little degradation of radiographic parameters resulting from the distribution of material over one centimeter compared to the usual one millimeter. Examples also showed that pressure relief in the foils resulted in significantly less radial deformation.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A distributed converter for converting electron energy to irradiative energy comprising at least two foils of a high-Z material; a foam in which said at least two foils are embedded; and a holder for confining said at least two foils and said foam.

2. The distributed converter of claim 1 wherein said foam is of a low density and made from a low atomic weight material.

3. The distributed converter of claim 1 wherein said foam contributes insignificantly to the irradiative energy.

4. A method of generating X-rays comprising the following steps:

providing an electron beam;

providing foam comprising a high-Z material; and administering the electron beam to the foam to thereby generate X-rays.

5. A method of generating X-rays as called for in claim 4 wherein the step of providing foam comprising a high-Z material comprises:

disposing a foam of a high-Z material in a holder for radially confining the foam of high-z material within the holder during the step of administering the electron beam.

6. A method of generating X-rays as called for in claim 4 wherein the step of providing foam comprising a high-Z material comprises:

disposing a foam of a high-Z material in tube for radially confining the foam of high-Z material within the tube during the step of administering the electron beam; and wherein the step of administering the electron beam to the foam to thereby generate X-rays comprises:

directing the electron beam into the foam along the axis of the tube.

7. A method of performing radiography comprising the following steps:

providing a pulseable electron beam;

providing foam comprising a high-Z material;

administering at least one electron beam pulse to the foam to thereby generate X-rays;

passing the generated X-rays through a sample; and registering the X-rays passing through the sample to thereby generate an image of the sample.

8. A distributed converter for generating X-rays from an electron beam comprising:

a foam target of a high-Z material for providing an extended target into which said electron beam is directed; and a holder for holding and radially confining said foam target when said electron beam is directed into said foam target.

9. The distributed converter of claim 8 wherein said holder is of like material to said foam.

10. The distributed converter of claim 9 wherein said foam target includes at least one foil of high-Z material embedded in said foam.

11. The distributed converter of claim 8 wherein said foam is of an open-cell structure.

12. The distributed converter of claim 8 wherein said holder said foam target is circular in cross-section and said holder is a tube.

* * * * *